United States Patent [19]

Diller et al.

[11] 3,987,385

[45] Oct. 19, 1976

[54] CONSTANT FORCE SOLENOID

[75] Inventors: Robert W. Diller, Pasadena; David A. Evans, Altadena, both of Calif.

[73] Assignee: Technar Incorporated, Arcadia, Calif.

[22] Filed: May 23, 1975

[21] Appl. No.: 580,428

[52] U.S. Cl. ..... 335/258; 335/261

[51] Int. Cl.[2] ..... H01F 7/08

[58] Field of Search ..... 335/255, 261, 262, 279, 335/258

[56] References Cited

UNITED STATES PATENTS

| | | | |
|---|---|---|---|
| 1,436,639 | 11/1922 | Bindschedler | 335/262 |
| 2,853,659 | 9/1958 | Herion | 335/262 |
| 3,378,732 | 4/1968 | Dietz et al. | 335/255 X |
| 3,593,240 | 7/1971 | Garczynski | 335/261 X |

*Primary Examiner*—George Harris

*Attorney, Agent, or Firm*—Christie, Parker & Hale

[57] ABSTRACT

A solenoid in which the coil is positioned inside a housing of magnetic material. The housing has a tubular projection forming a recess in the inside of the end wall along the axis of the coil, one end of the plunger projecting beyond the coil into the recess when the plunger is in the energized position. The portion of the plunger that extends into the recess is tapered to obtain a constant force-displacement characteristic for the full travel of the plunger.

2 Claims, 3 Drawing Figures

CONSTANT FORCE SOLENOID

FIELD OF THE INVENTION

This invention relates to solenoid actuators, and more particularly to a solenoid actuator having an improved force versus deflection characteristic.

BACKGROUND OF THE INVENTION

A simple solenoid consists of a coil and a plunger. When one end of the plunger is placed in or near the end of the coil, it becomes magnetized, and mutual attraction results between the flux in the plunger and the magnetic force due to the ampere-turns in the winding of the solenoid. The plunger becomes more and more saturated as it enters the solenoid. The pull on the plunger drops to zero when the plunger is magnetically centered in the solenoid. The pulling force of a solenoid can be greatly enhanced by enclosing the coil in a frame of magnetic material. This adds an additional component to the pulling force of the solenoid, namely, the pull between the frame and the end of the plunger. As the air gap between the end of the plunger and the frame decreases, the latter component becomes predominant and the pulling force as a function of the deflection of the plunger rises rapidly as the gap approaches zero. While the addition of the frame of magnetic material greatly increases the force at which the solenoid "locks in", it does not improve the performance of the solenoid over an extended range of movement. This has only been accomplished in the past by increasing the component of force produced by the solenoid action between the coil and the plunger, namely, by increasing the ampere-turns of the coil or other parameters, such as the cross-sectional area of the plunger, the proportions of the coil, and the degree of saturation and length of the plunger.

SUMMARY OF THE INVENTION

The present invention is directed to an improved solenoid design which provides a high level of pull over an extended deflection range of the plunger without increasing the ampere-turns or physical size of the coil. This is accomplished, in brief, by providing a solenoid in which the magnetic frame or housing has a tubular portion projecting from the end wall in axial alignment with the plunger. The inner diameter of the tubular portion is slightly larger in diameter than the plunger, the end of the plunger being drawn into the tubular portion of the end wall when the solenoid is energized. By tapering the end of the plunger where it enters the tubular portion, the force versus displacement characteristics can be controlled to provide a substantially high level of force which is constant over the full range of movement of the plunger after it enters the tubular portion.

DESCRIPTION OF THE DRAWINGS

For a more complete understanding of the invention, reference should be made to the accompanying drawings, wherein.

DETAILED DESCRIPTION

Figure 1:
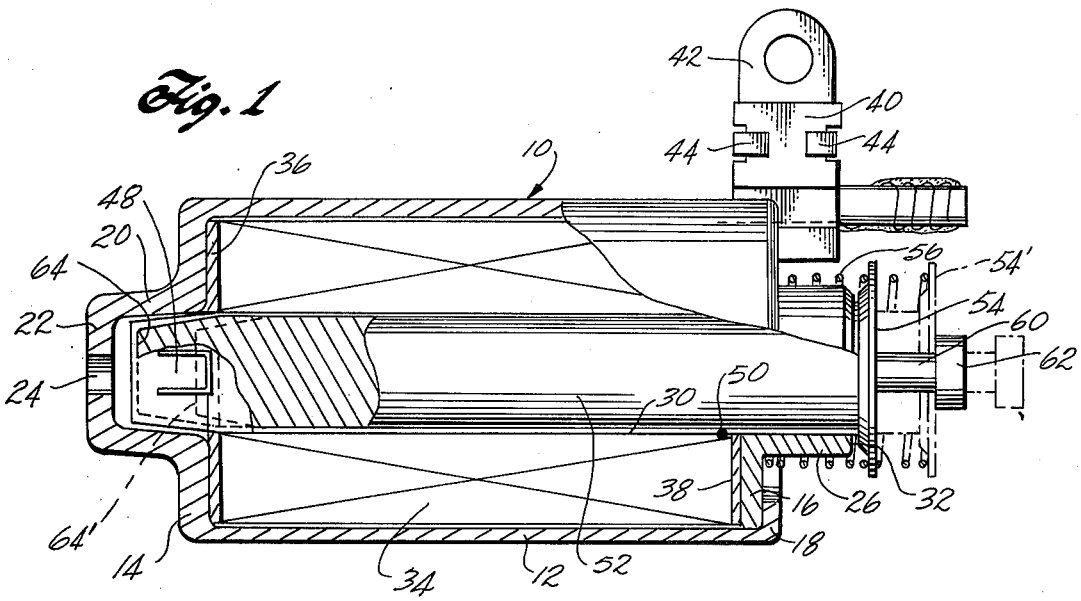
FIG. 1 is an elevational view in section of a solenoid incorporating the features of the present invention.

Referring to the drawings in detail, the numeral 10 indicates generally the housing of the solenoid. The housing consists of two parts. One part is in the form of a deep drawn case of steel or other suitable magnetic material and includes a cylindrical outer side wall 12 and an end wall 14. The other part of the housing 10 includes an end wall 16 which is positioned inside the open end of the side wall 12 and is retained in place by a lip 18, which is formed after the end wall 16 is in place by rolling over the edge of the side wall 12. The end wall 14 is provided with a projecting tubular portion 20 which is coaxial with the cylindrical side wall 12. The cylindrical portion 20 terminates in an end wall 22 having a vent hole 24 therein.

The end wall 16 is provided with a projecting tubular portion 26 which is also coaxial with the tubular portion 20. The tubular portion 26 provides a sleeve which surrounds a thin walled tubular member 30 made of an electrically conductive but non-magnetic material, such as brass or stainless steel. One end of the tubular member 30 terminates in an outwardly projecting lip 32 which engages the outer end of the tubular portion 26. The other end of the tubular member 30 extends into the recess formed by the tubular portion 20 of the end wall 14. The inside of the tubular portion 20 may be tapered slightly to make it easier to form by the deep drawing process. If so, the inner end of the tubular member 30 may also be tapered slightly so that it will fit snugly in the recess.

A solenoid coil 34 is wound on the tubular member 30. A suitable thin layer of insulating material, such as an electrical tape or the like, may be provided on the outside of the tubular member 30 for insulation between the coil and the tubular member. A plastic washer 36 is mounted on the tubular member 30 on one end of the coil. Similarly a plastic washer 38 is mounted on the tubular member 30 at the other end of the coil. The washer 38 has an integrally moulded external terminal mounting lug 40 which extends outside of the housing 10 to which is secured an L-shaped metal terminal 42. The metal terminal 42 is locked to the lug 40 by a pair of integral tabs 44 which are bent around and clamp the metal terminal to the lug. One end of the coil 34 is soldered to the terminal 42 while the other end of the coil is grounded to the frame of the solenoid by soldering it to the tubular member 30, as indicated at 50.

The coil 34 is preferably formed by mounting the tubular member 30 on a rotating arbor. The sleeve formed by the tubular portion 26 is slipped over the tapered end of the tubular member 30 and positioned against the lip 32. The washer 38 is then slipped on to the tubular member 30 followed by the washer 36. The tapered end of the tubular member 30 has a plurality of integrally formed tabs 48 which spring outwardly and retain the washer 36 in place after it has been inserted over the end of the tubular member 30. After one end of suitable magnet wire is soldered to the outside of the tubular member 30 adjacent the washer 38 at 50, the wire is wound to form the coil 34 by rotating the arbor on which the tubular member 30 is supported. When the winding operation is complete, the remaining end of the wire is soldered to the terminal 42. After the coil 34 is completely wound it holds the assembly together by pressing the washer 38 against the end wall 16 while pressing the washer 36 against the projecting tabs 48.

The coil assembly is then removed from the arbor and inserted in the housing 10 with the tubular member 30 extending into the tapered recess formed by the tubular portion 20 of the end wall 14. The edge of the cylindrical wall 12 is then rolled over to form the lip 18 which retains the coil assembly and end wall 16 in place.

After assembly of the solenoid, a plunger 52 is inserted into the open end of the tubular member 30. The plunger 52 is of slightly smaller diameter than the interior of the tubular member 30 so as to slide freely in an axial direction. The outer end of the plunger 52 is provided with a flange 54. When the coil 34 is energized, the plunger is moved in a direction to bring the flange 54 into contact with the lip 32 of the tubular member 30. This compresses a coil spring 56 which surrounds the tubular portion 26 and extends between the flange 54 and the outside of the end wall 16. When the coil 34 is de-energized, the spring moves the flange 54 back out to the dotted position indicated at 54'. The plunger 52 may be coupled to a load through any suitable means, such as a projecting rod 60 terminating in a flange 62.

The distance of movement of the plunger 52 between the energized and the de-energized positions is such that the inner end of the plunger 52, indicated at 64, moves from a position substantially aligned with the end wall 14, as indicated at the dotted line position 64' to the energized position in which the surface 64 is separated from the end wall portion 22 by a very small gap. The portion of the plunger 52 which projects into the recess formed by the tubular portion 20 of the end wall 14 is tapered over a length of the plunger approximately equal to the length of travel of the plunger between the de-energized and energized positions. The degree of taper exceeds any taper of the inside surface of the tubular portion 20 by an amount, for example, of the order of 10 degrees. However, the degree of taper depends on the operating characteristics desired for a particular solenoid.

Figure 2:
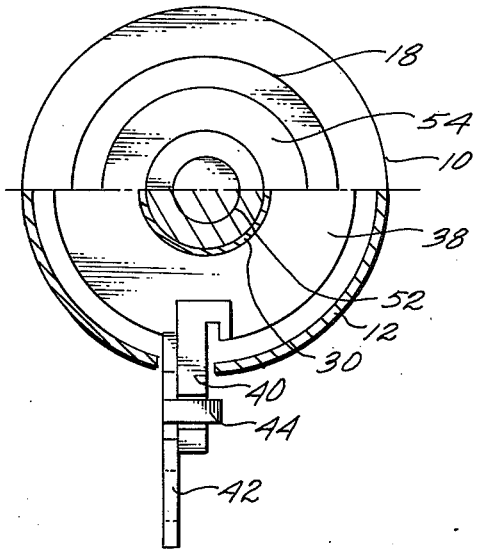
FIG. 2 is an end view of the solenoid.
Figure 3:
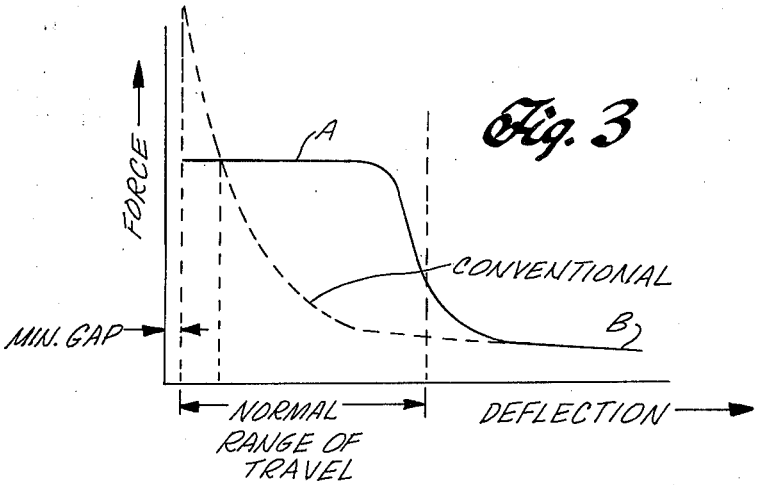
FIG. 3 is a diagram of the force versus deflection characteristic of the solenoid.

The operation of the solenoid is shown by the force versus deflection curves of FIG. 3. In the conventional solenoid in which the frame has a flat end wall forming an air gap with the end of the plunger, the force deflection characteristic is shown by the dotted line in FIG. 3. For a large displacement of the plunger, as indicated at B, the force is at a rather low level and is substantially constant. As the plunger is drawn into the solenoid and the gap effect at the end of the plunger becomes more pronounced, the force increases exponentially to a rather high level as the end of the plunger reaches the minimum gap position. In contrast, a solenoid constructed in the manner described above in connection with FIGS. 1 and 2, as the end of the plunger moves into the recess, the force increases rapidly to a plateau at A. As the end of the plunger continues to move into the recess formed by the tubular portion 20, the level of force remains at a high level. The slope of the plateau region A depends on the degree of taper at the end of the plunger. By further increasing the degree of taper and accordingly reducing the area of the end of the plunger, the plateau region A can actually have a negative slope.

The advantage of the present invention is evident from the curve of FIG. 3. The two curves assume a solenoid having the same number of ampere-turns. Thus the present invention provides a solenoid with an extended range of travel in which the pulling force is at an elevated level, and preferably a substantially constant level throughout the range of travel. Such a solenoid is of particular value in operating a mechanical load where the tolerances are such that the point of travel of the solenoid in which the load peaks is not well defined. In a conventional solenoid, if the load peaks near the point of maximum deflection, the solenoid force may be insufficient. To design the solenoid so that its force at maximum deflection is sufficient to overcome the peak load would require a greatly overdesigned solenoid. In addition, the solenoid according to the present invention provides high efficiency with reduced manufacturing costs.

What is claimed is:

1. A solenoid comprising:

a tubular member of non-magnetic material; a plunger slidably supported in the tubular member; a conductive coil surrounding the tubular member; a housing of magnetic material having a cylindrical portion surrounding the coil, an open end portion enclosing one end of the coil, the open end portion having a sleeve projecting away from the coil and concentric with the tubular member, and a closed end portion having a tubular portion projecting away from the coil and concentric with the tubular member, and a radial portion extending between the tubular portion and the end of the cylindrical portion, the cylindrical portion, tubular portion, and radial portion being formed from a single piece of magnetic material, and stop means limiting movement of the plunger toward the closed end of the housing when the coil is energized with an electric current, one end of the plunger projecting beyond the coil into the tubular portion of the closed end of the housing when the plunger engages the stop means, the end of the plunger projecting into said tubular portion of the closed end of the housing being tapered, the length of the tapered portion corresponding to the full length of the plunger extending outside the coil into the tubular portion when the plunger is in the energized position.

2. Apparatus of claim 1 wherein the tapered end of the plunger terminates in a flat end, and the tubular portion of the closed end of the housing has an end wall, the flat end being spaced in an air gap when the plunger engages the stop means.

* * * * *